US007230573B2

(12) United States Patent
Lin et al.

(10) Patent No.: US 7,230,573 B2
(45) Date of Patent: Jun. 12, 2007

(54) DUAL-BAND ANTENNA WITH AN IMPEDANCE TRANSFORMER

(75) Inventors: Hsien-Chu Lin, Tu-Chen (TW); Lung Sheng Tai, Tu-Chen (TW); Chen-Ta Hung, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 59 days.

(21) Appl. No.: 11/025,169

(22) Filed: Dec. 28, 2004

(65) Prior Publication Data

US 2005/0200556 A1 Sep. 15, 2005

(30) Foreign Application Priority Data

Mar. 9, 2004 (TW) ..... 093203508 U

(51) Int. Cl.
*H01Q 1/38* (2006.01)

(52) U.S. Cl. ..... 343/700 MS; 343/702; 343/846

(58) Field of Classification Search ..... 343/702, 343/700, 767, 770, 846
See application file for complete search history.

(56) References Cited

U.S. PATENT DOCUMENTS

| | | | | |
|---|---|---|---|---|
| 4,360,813 | A * | 11/1982 | Fitzsimmons | 342/350 |
| 6,563,468 | B2 * | 5/2003 | Hill et al. | 343/741 |
| 6,600,448 | B2 * | 7/2003 | Ikegaya et al. | 343/700 MS |
| 6,985,108 | B2 * | 1/2006 | Mikkola et al. | 343/700 MS |
| 2005/0078037 | A1 * | 4/2005 | Leclerc et al. | 343/702 |

* cited by examiner

*Primary Examiner*—Tho Phan
(74) *Attorney, Agent, or Firm*—Wei Te Chung

(57) ABSTRACT

A dual-band antenna (1) for communication device includes a first radiating element portion (10) operating at a first frequency band, a second radiating element portion (20) operating at a second frequency band, an L-shaped ground portion (40), a conductive connection (50) interconnecting the first and second radiating element portions (10, 20) with the ground portion (40) and a slot (101) served as an impedance transformer and positioned on the ground portion (40). The slot (101) is implemented as a capacitive load that eliminates the inductive part of the input impedance of the antenna, thereby the slot (101) can match the input impedance of the antenna with a feed line.

18 Claims, 13 Drawing Sheets

DUAL-BAND ANTENNA WITH AN IMPEDANCE TRANSFORMER

BACKGROUND OF THE INVENTION

1. Field of the Invention

The present invention relates generally to an antenna, and more particularly to a dual-band antenna for use with a wireless communication device.

2. Description of the Prior Art

With the development of wireless communication technology, various products such as mobile computers for dual-band communication have high performance to meet the consumers' demands. Accordingly, if a mobile computer with wireless communication function desires to have high performance, it is critical for it to have a well-designed antenna, which having high gain, high directivity when required and characteristics that can be applied in dual frequency bands.

Conventional antennas generally adapted to wireless communication products such as mobile computers are substantially grouped into two types, wherein one is external antenna and the other is internal antenna. The external antenna protrudes a relatively long distance from the body of the mobile computer, which makes the computer aesthetically unpleasing and inconvenient to move. In addition, the antenna is often bent, broken, knocked out of alignment or otherwise damaged because they can easily catch or strike objects such as people, walls, doors, etc. Furthermore, the antenna requires a large support structure to secure the antenna to the housing of the computer and this support structure requires a considerable amount of space inside the body of the computer. This space is valuable, especially in small, portable computer.

Accordingly, in order to clear said problem of the external antenna, various kinds of internal antennas dedicated to mobile computers are extensively used, which include slot antennas, microstrip antennas, planar inverted-F antennas (PIFA), spiral antennas and so on. A typical conventional planar inverted-F antenna (PIFA) is disclosed in U.S. Pat. No. 6,600,448 issued to Ikegaya et al on Jul. 29, 2003. The antenna provided in the Ikegaya's patent is a thin flat-plate antenna having a slit, which has a specified width and a specified length and is formed in a conductive flat plate. A radiating element portion shaped like a monopole antenna and a ground portion are formed with the slit between them. Although, the planar inverted-F antennas (PIFA) are structured so compact and lightweight, it can only operate in a single frequency band, which limits the use of this conventional antenna. Therefore, it is expected to develop an antenna adapted for dual frequency bands along with the mainstream trend of related communication device. For example, U.S. application Ser. No. 10/330959 filed by the same applicant discloses a dual-band antenna, which is able to operate in dual frequency bands (such as 2.4 GHz and 5.2 GHz) and has a compact shape particularly adapted to the communication products such as mobile computers. Horizontal portions of this antenna separated from each other serve as radiating element portions and a ground portion, respectively. A connection strip with respect to a feeding point thereof links the radiating element portions and ground portion. A coaxial feed cable is soldered onto the connection strip. The impedance matching between the antenna and the coaxial cable is realized by moving the feed point at the connection strip of the antenna. However, this means is limited by physical dimensions of connection strip and may influence the resonant frequencies of the antenna. Consequently, how to choose the feed point, which makes the antenna attain impedance matching and desired resonant frequencies as well, is relatively concerned.

Hence, it is necessary to provide a build-in antenna, which is capable of operate not in less than dual frequency bands and can easily achieve impedance matching between the antenna and the coaxial cable.

BRIEF SUMMARY OF THE INVENTION

It is an object of the present invention to provide a dual-band antenna can be easily adjusted for impedance matching with its coaxial feed line.

To achieve the aforementioned object, the present invention provides a dual-band antenna which is adapted to a metallic sheet, comprising two radiating element portions, a ground portion and a slot for impedance matching formed on the ground portion. The slot is implemented as a capacitive load that eliminates the inductive part of the input impedance, thereby it matches the signal input impedance. The dimensions of the slot are calculated by running simulations to obtain the desired impedance characteristics. The coaxial cable has a core conductor connected to the conductor part adjacent to the radiating element portions and an external conductor connected to the ground portion respectively.

Additional novel features and advantages of the present invention will become apparent by reference to the following detailed description when taken in conjunction with the accompanying drawings.

DETAILED DESCRIPTION OF THE INVENTION

Reference will now be made in detail to a preferred embodiment of the present invention.

Figure 1:
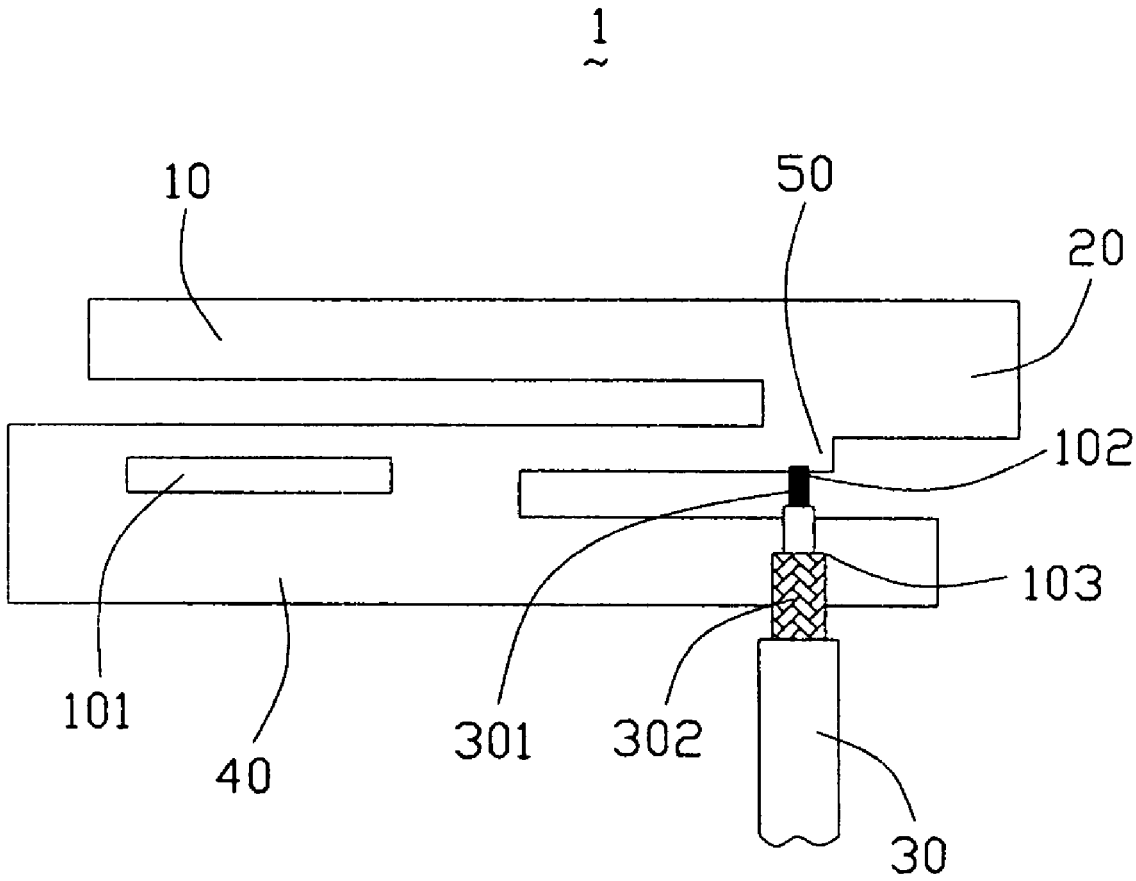
FIG. 1 is a top view of a dual-band antenna in accordance with the present invention.

Referring to FIG. 1, a dual-band antenna 1 in accordance with a preferred embodiment of the present invention is formed of a planar metallic sheet, and includes a first and a second radiating element portions 10, 20 disposed at the horizontal direction, which are of different lengths and capable of being tuned to different frequency bands. The first radiating element portion 10 serves to generate a first (lower frequency) resonant frequency and the second radiating element portion 20 serves to generate a second (higher frequency) resonant frequency, wherein the length of the first radiating element portion 10 is selected to be ¼ wavelength of the central frequency of the first (lower frequency) resonant frequency, and that of the length of the second radiating element portion 20 is selected to be ¼ wavelength of the central frequency of the second (higher frequency) resonant frequency. The widths of the radiating element portions 10, 20 are different from each other. The second radiating element portion 20 is wider than the first radiating element portion 10.

A conductive connection 50, which has a feed point 102 thereon, interconnects the first and second radiating element portions 10, 20 with the ground portion 40 horizontally. One end of the conductive connection 50 is linked to a joint portion (not labeled) of the first and second radiating element portions 10, 20, and the other end is coupled to part of the ground portion 40. A core conductor 301 of a coaxial cable 30 is soldered onto the feed point 102 and the external conductor 302 of the coaxial cable 30 is electrically connected to the ground portion 40. Thus, a power supply structure is realized.

The ground portion 40 separated from the radiating element portions 10, 20 by two slits (not labeled) is constructed as L shape, and a slot 101 implemented as an impedance transformer is positioned thereon by means of a cutting or etching technique. The slot 101 has a special length and a special width, located in close proximity to and parallel to the first radiating element portion 10. When a feed point 102 is set approximately at the conductive connection 50, impedance matching can be adjusted by the slot 101, which increases the capacitive reactance part of the input impedance without concern about a change in the resonant frequencies. The dimensions or the shape of the slot are calculated by running simulations to obtain the desired impedance characteristics. Providing such a separate capacitive load removes the physical limit, allowing impedance matching easier and has no effect on resonant frequencies, compared with the impedance matching means described above.

The dual-band antenna 1 can be formed on a same major surface of a planar insulative substrate (such as a printed circuit board, not shown) besides be formed of a planar metallic sheet.

Figure 2:
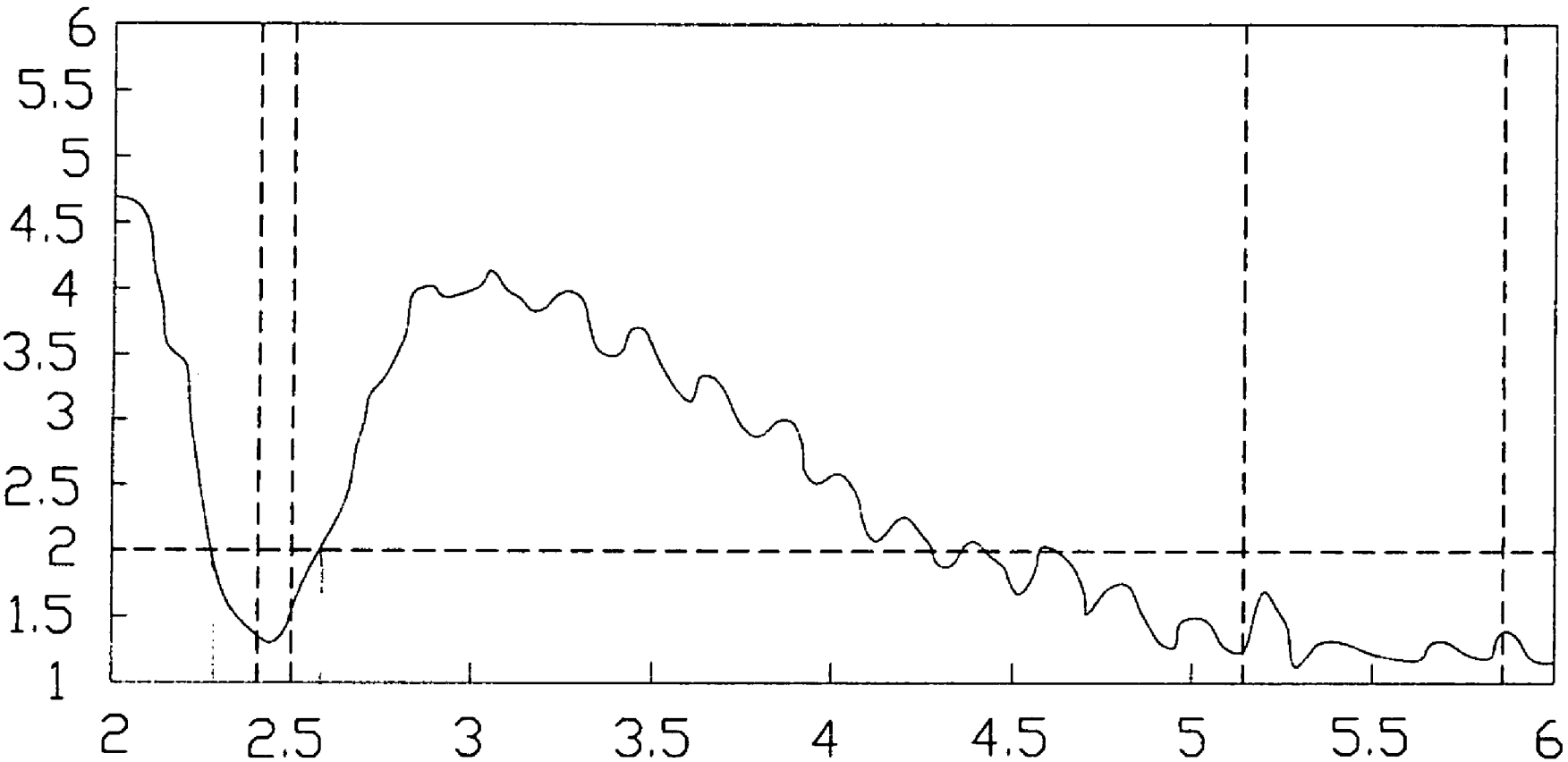
FIG. 2 is a test chart recording for the dual-band antenna of FIG. 1, showing Voltage Standing Wave Ratio (VSWR) as a function of frequency.
Figure 3:
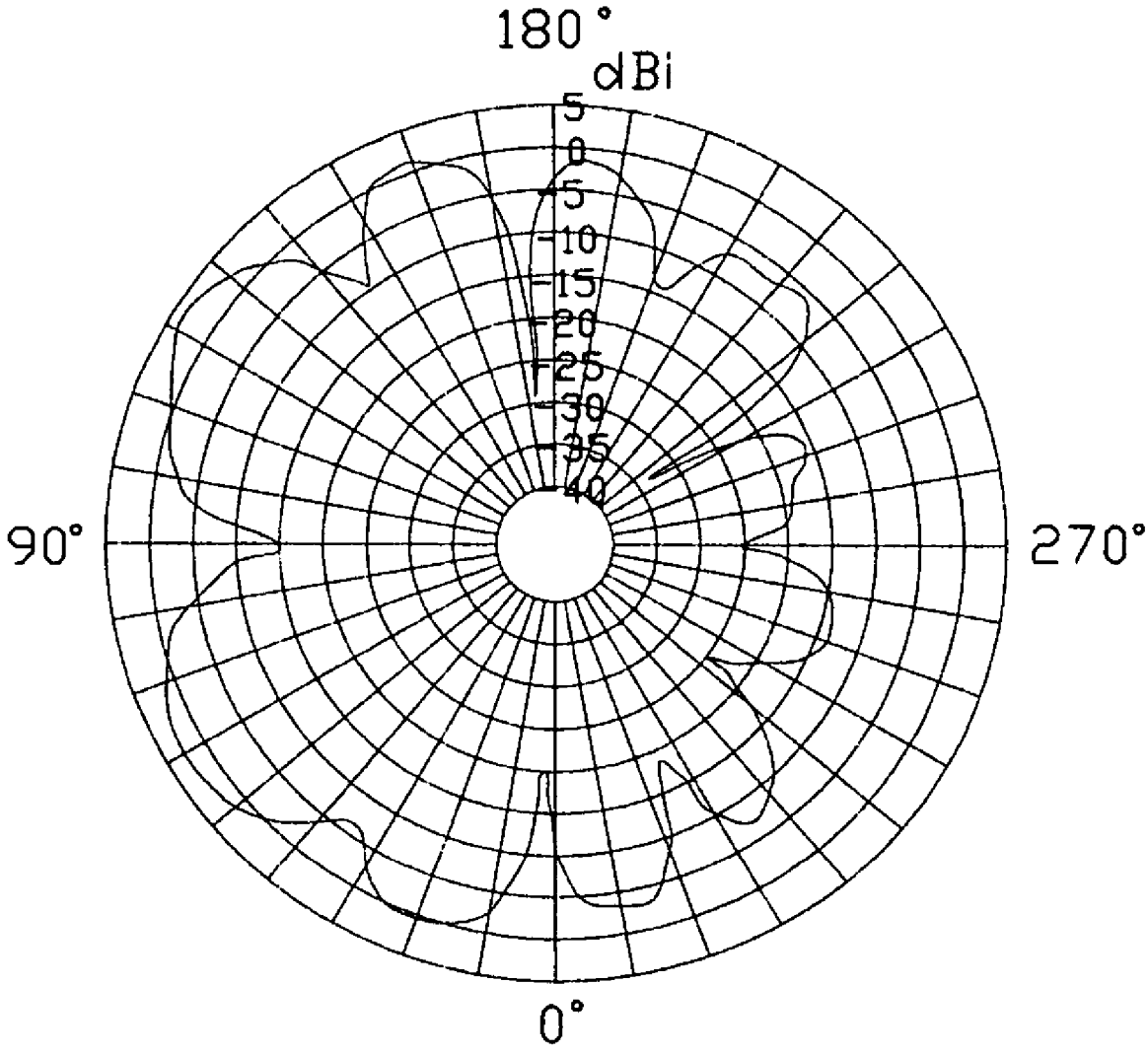
FIG. 3 is a horizontally polarized principle plane radiation pattern (where the principle plane is an X-Y plane) of the dual-band antenna of FIG. 1 operating at a frequency of 2.45 GHz.
Figure 4:
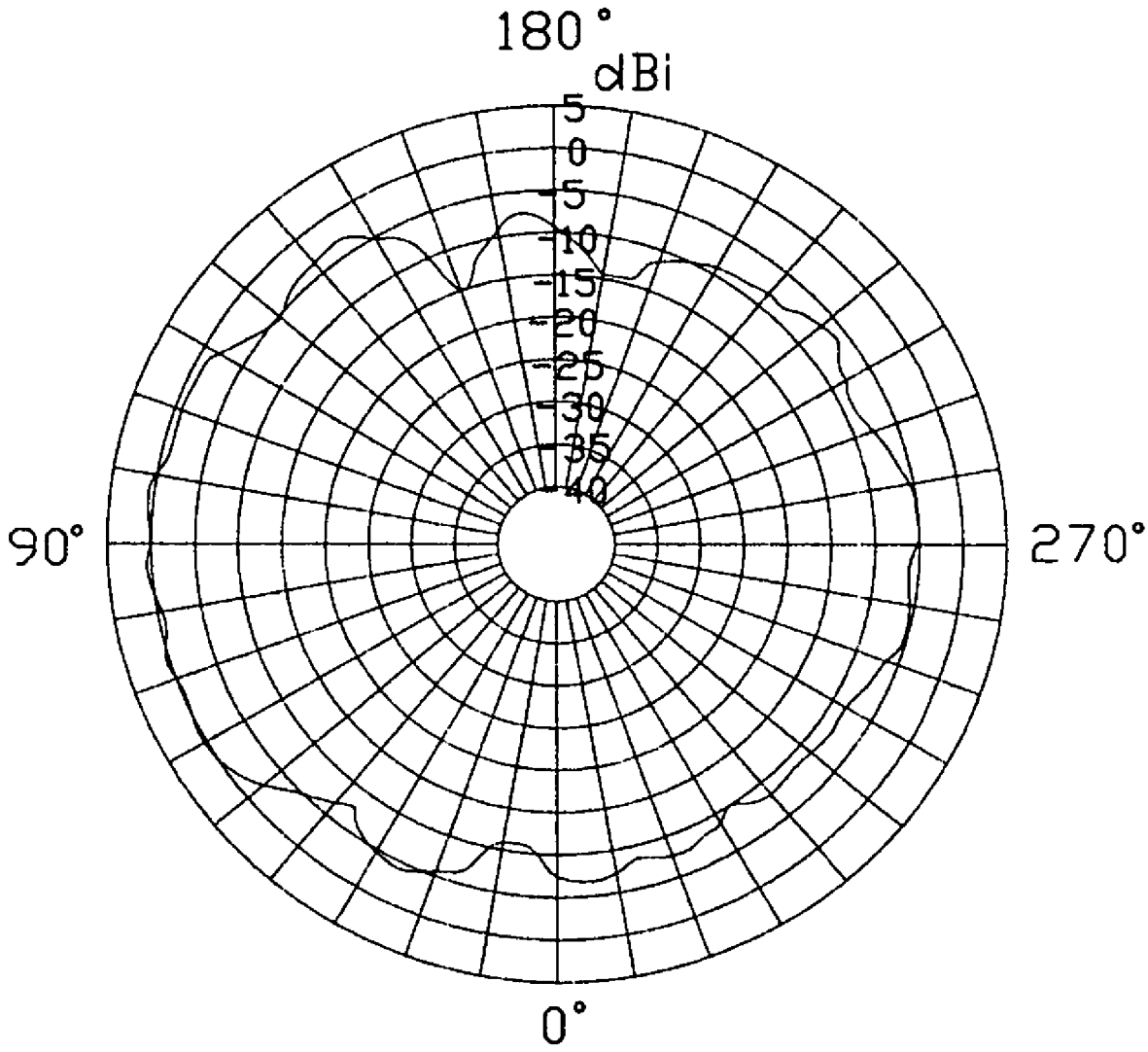
FIG. 4 is a vertically polarized principle plane radiation pattern (where the principle plane is an X-Y plane) of the dual-band antenna of FIG. 1 operating at a frequency of 2.45 GHz.
Figure 5:
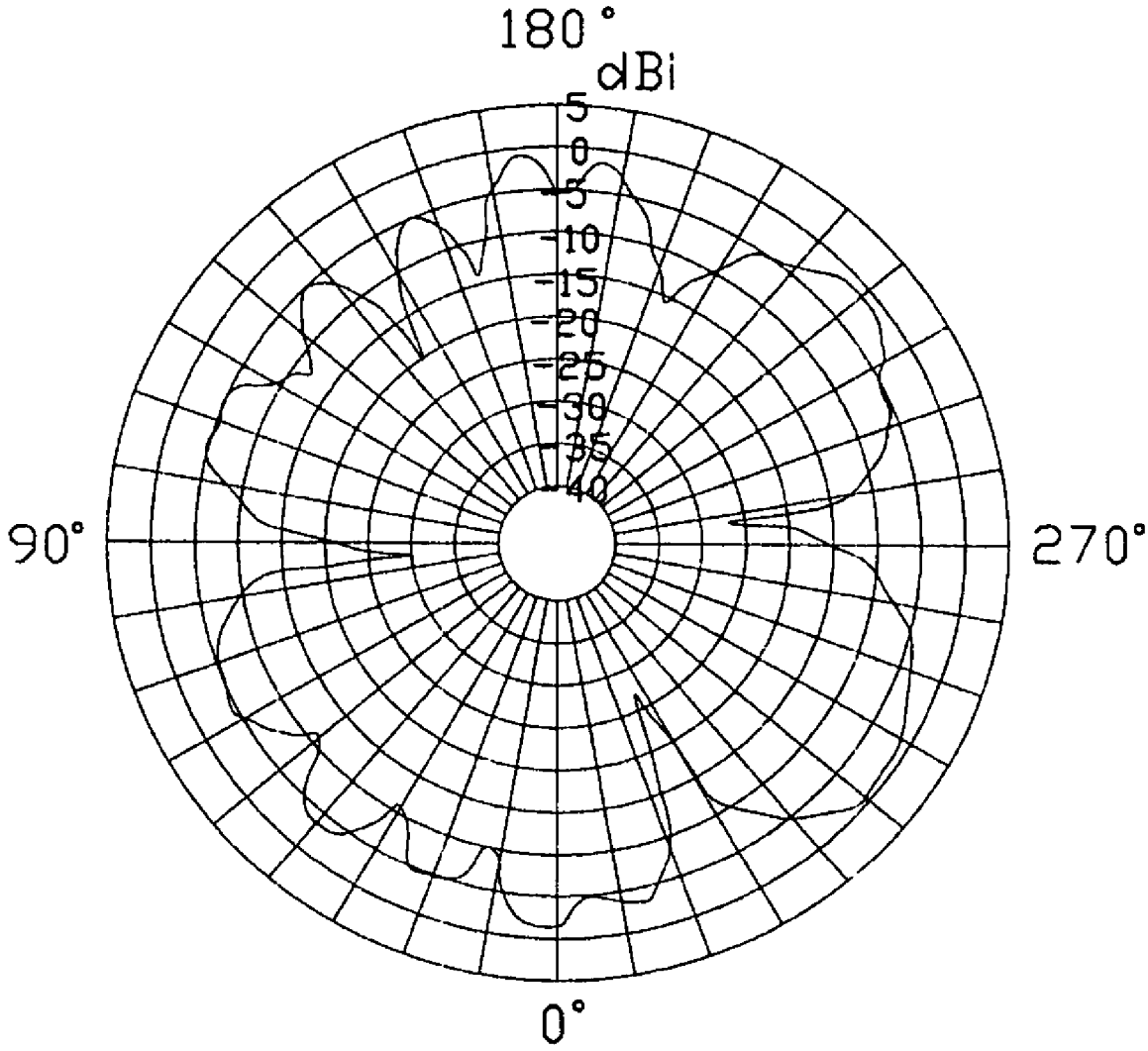
FIG. 5 is a horizontally polarized principle plane radiation pattern (where the principle plane is an X-Y plane) of the dual-band antenna of FIG. 1 operating at a frequency of 5.25 GHz.
Figure 6:
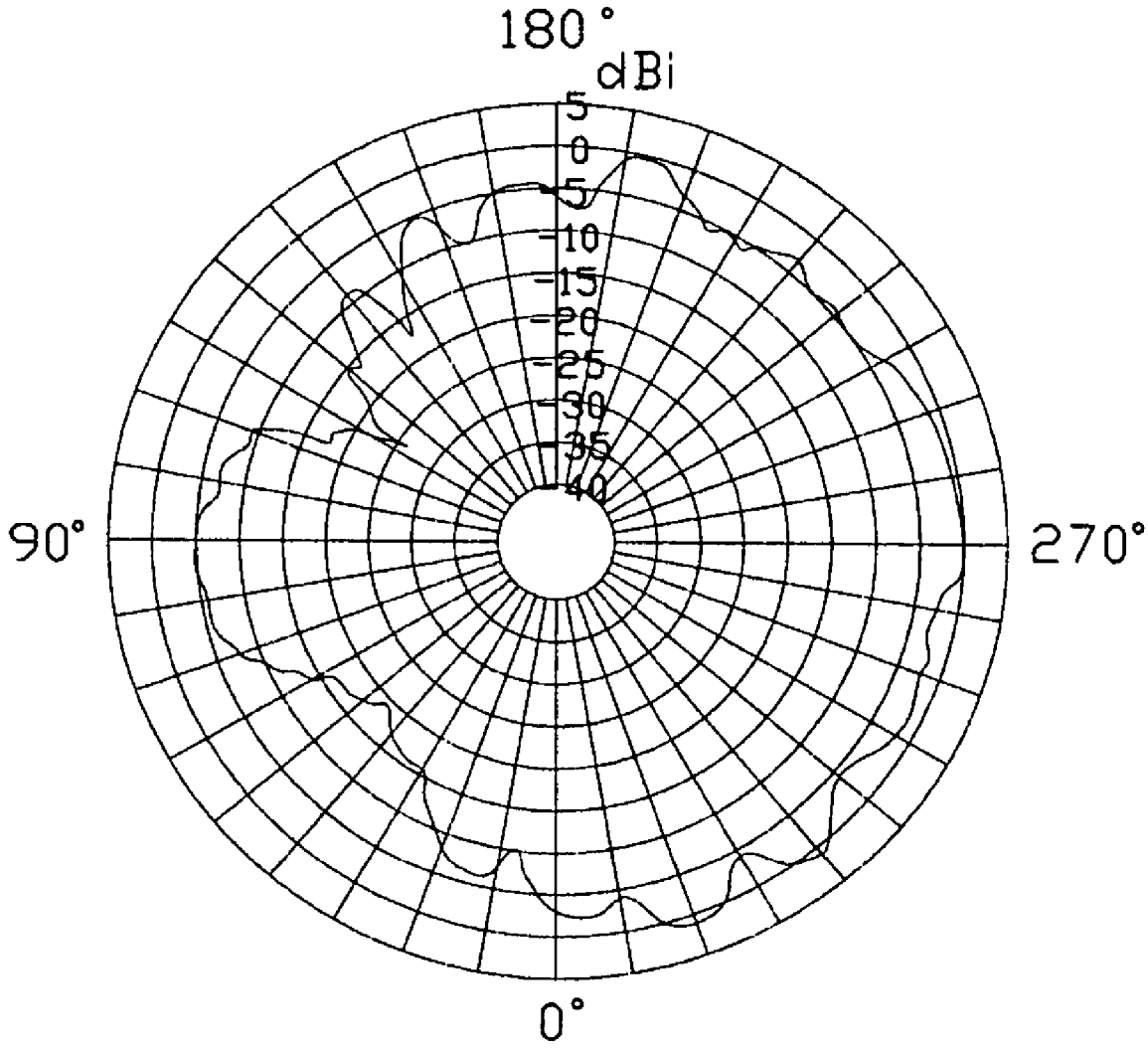
FIG. 6 is a vertically polarized principle plane radiation pattern (where the principle plane is an X-Y plane) of the dual-band antenna of FIG. 1 operating at a frequency of 5.25 GHz.
Figure 7:
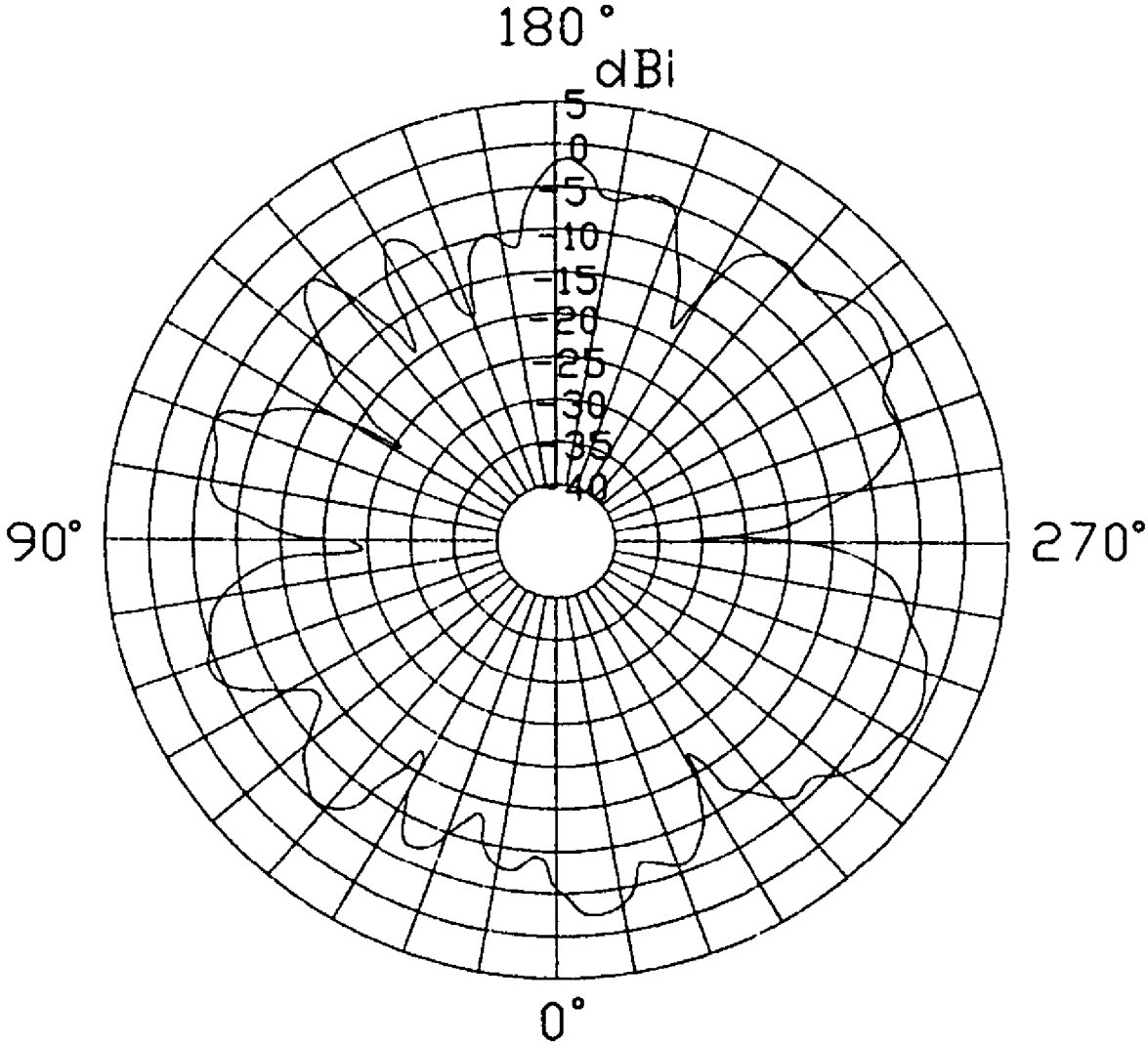
FIG. 7 is a horizontally polarized principle plane radiation pattern (where the principle plane is an X-Y plane) of the dual-band antenna of FIG. 1 operating at a frequency of 5.8 GHz.
Figure 8:
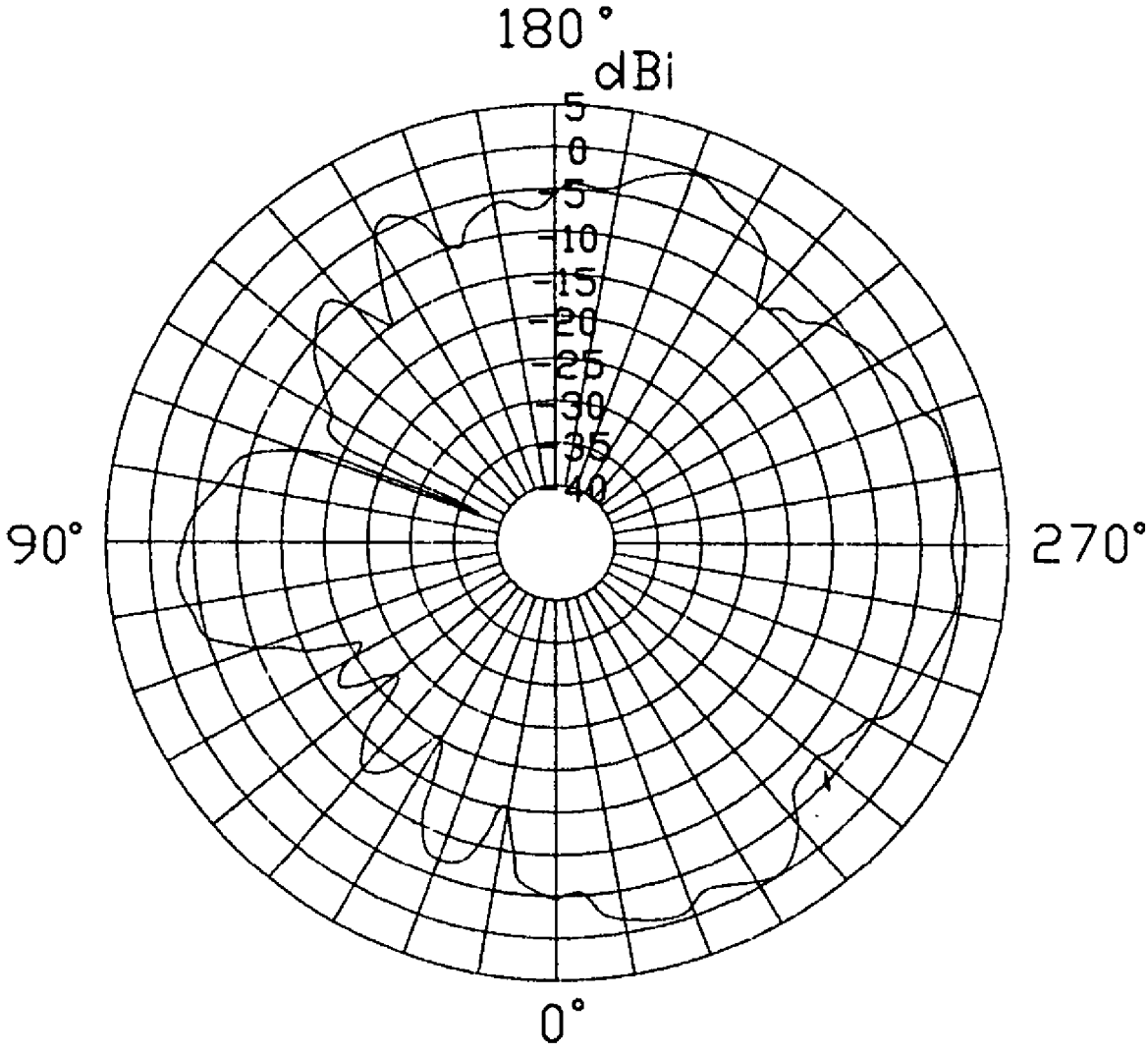
FIG. 8 is a vertically polarized principle plane radiation pattern (where the principle plane is an X-Y plane) of the dual-band antenna of FIG. 1 operating at a frequency of 5.8 GHz.
Figure 9:
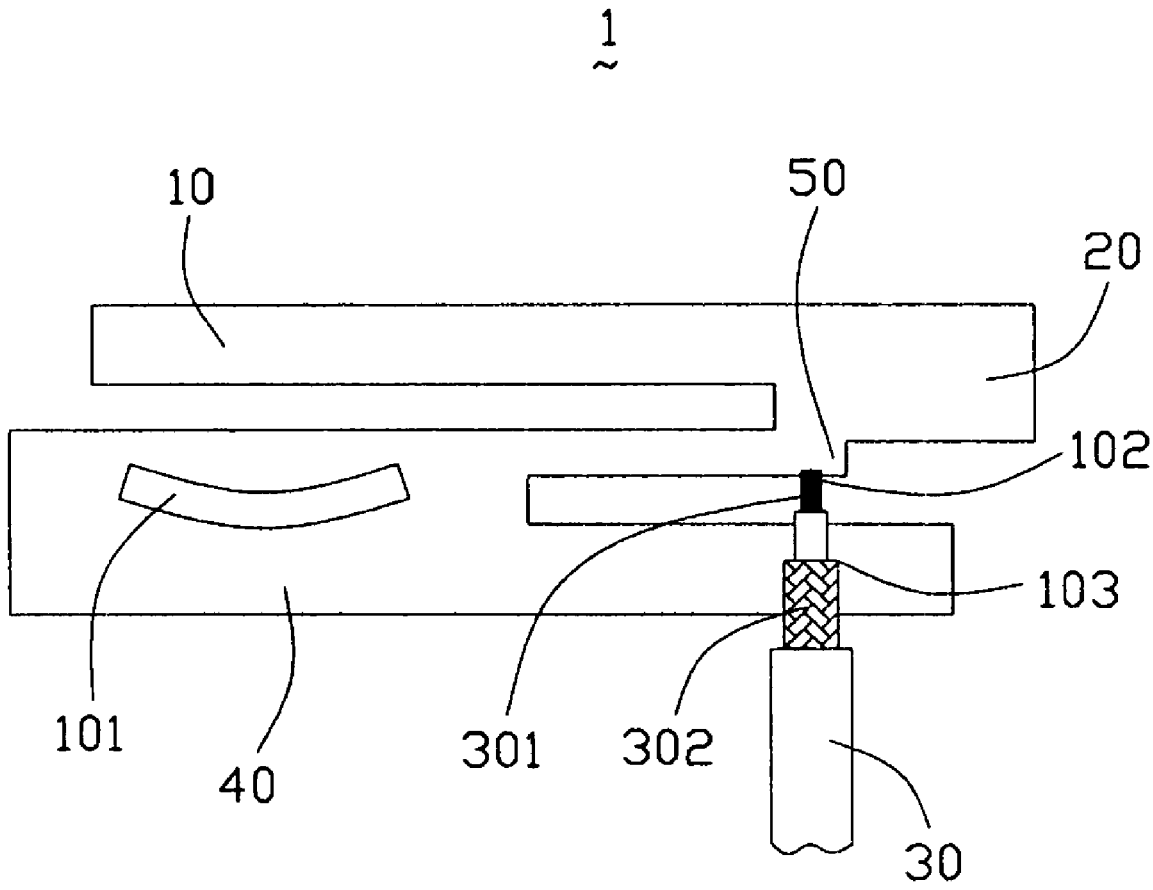
FIGS. 9–13 show modified structures of the capacitive load slot of the present invention.
Figure 10:
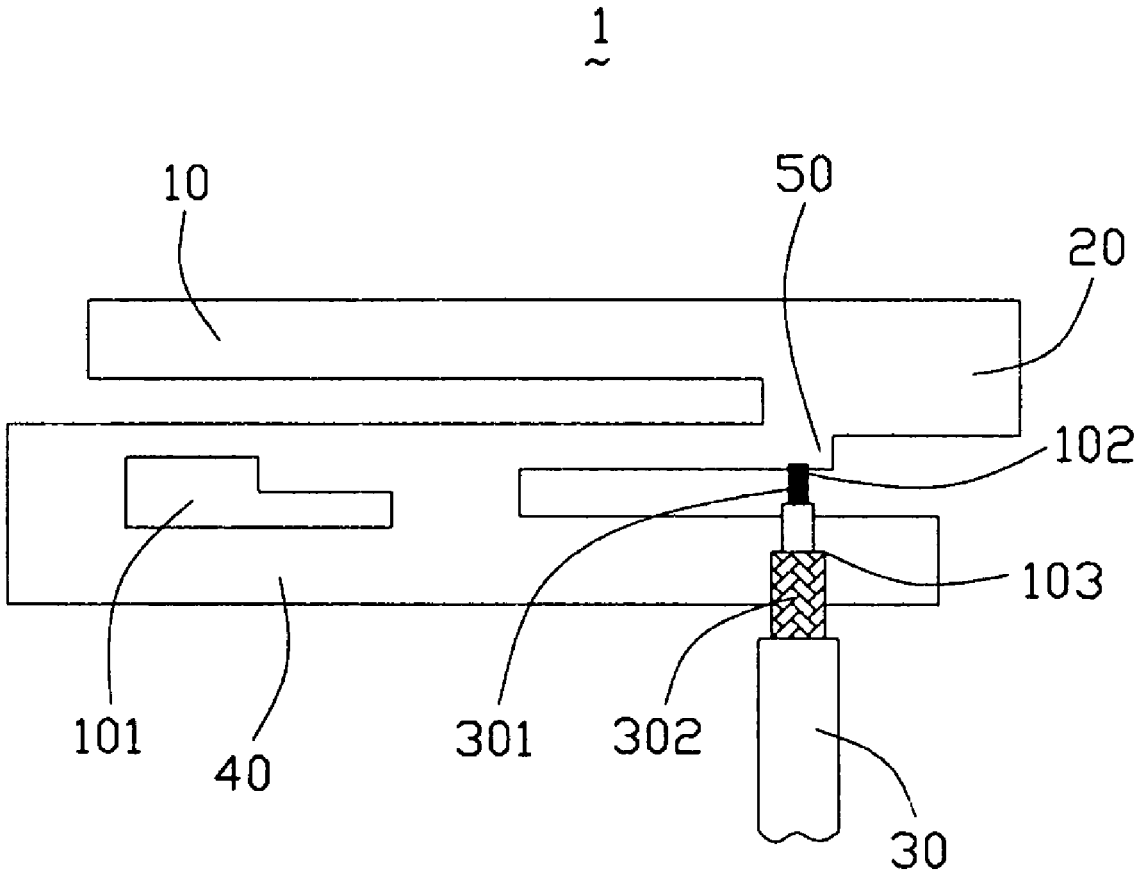
Figure 11:
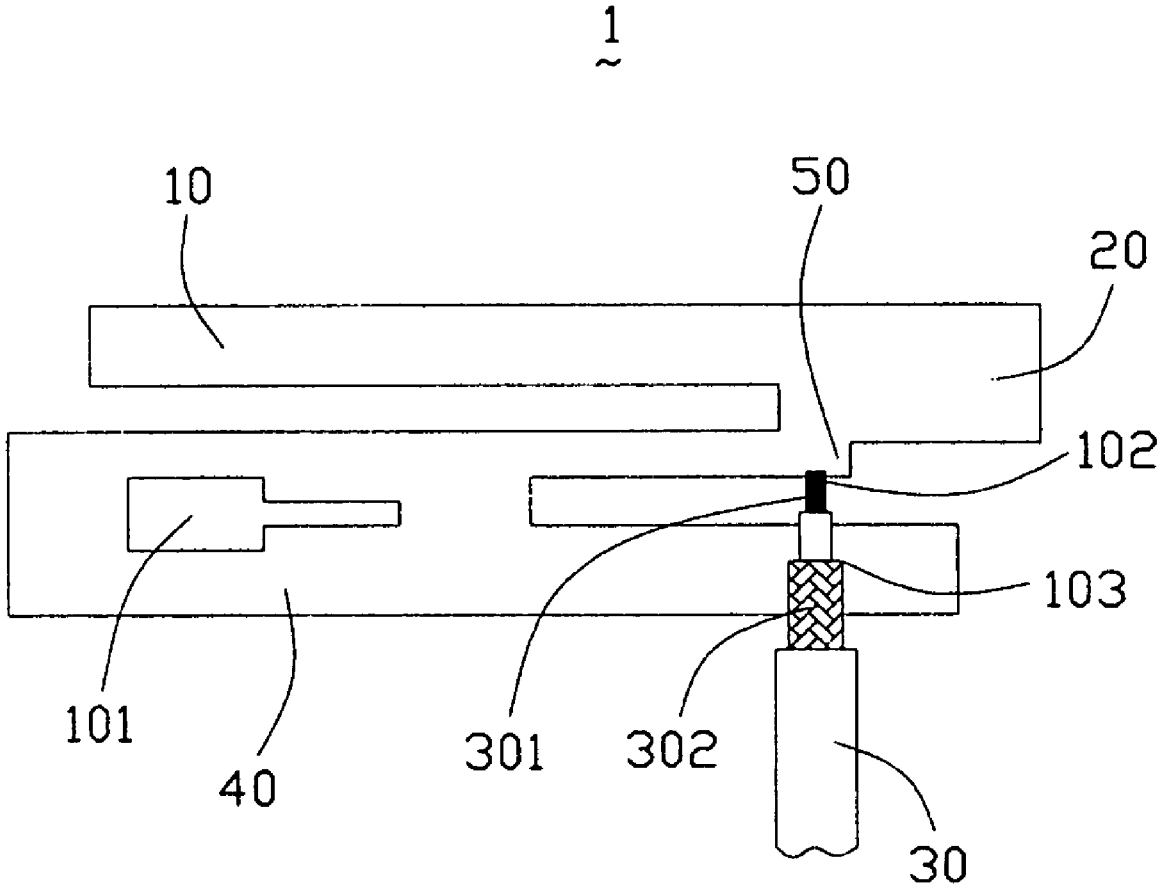
Figure 12:
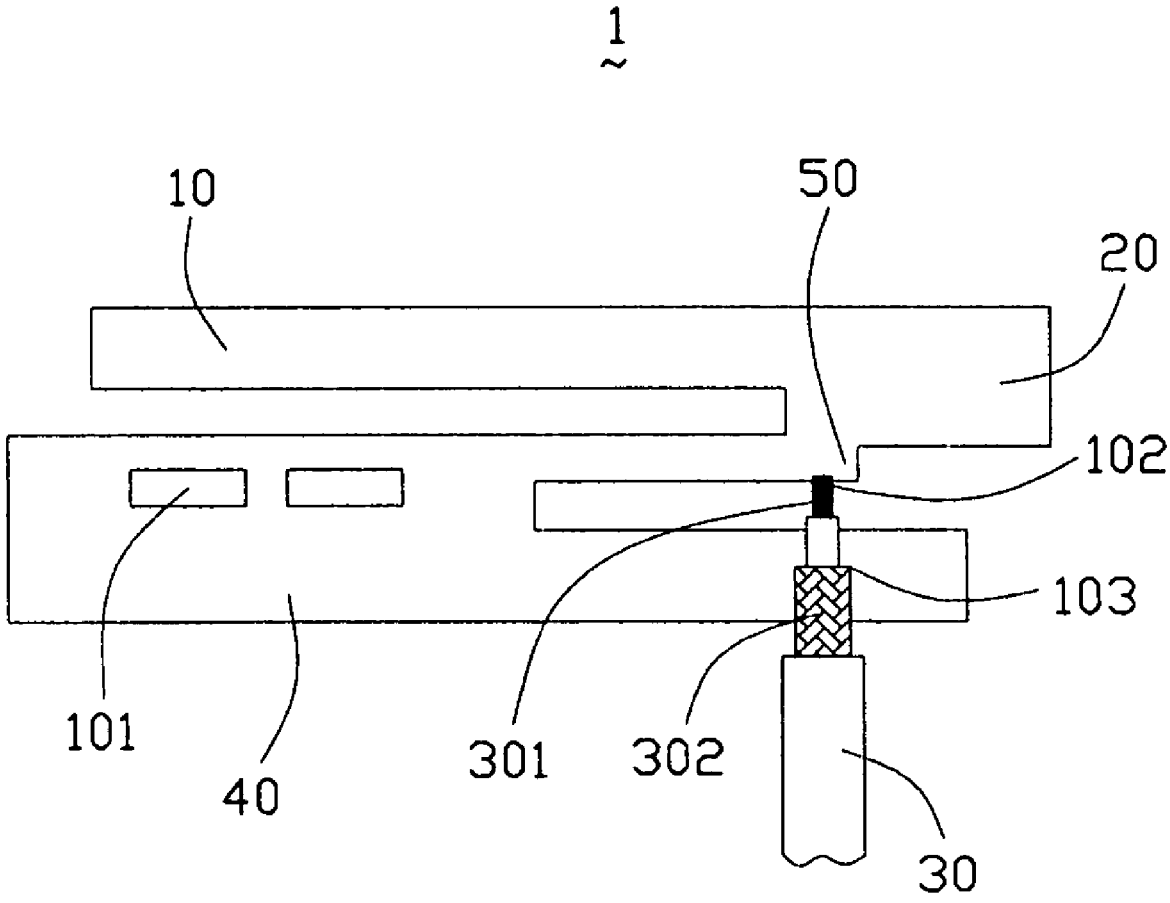
Figure 13:
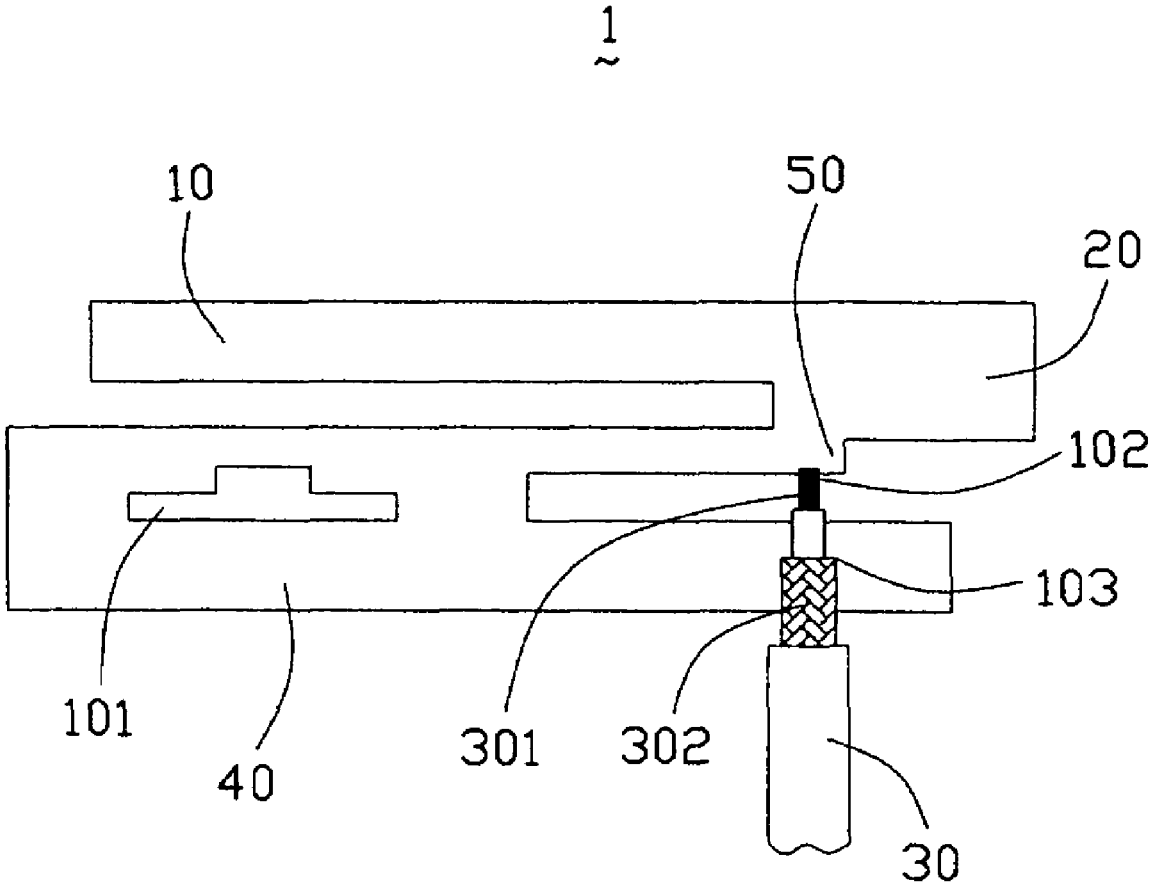

Referring to FIG. 2, the central frequency of the first resonant frequency band is around 2.45 GHz, and that of the second resonant frequency band is around 5.5 GHz. Furthermore, under the definition of the voltage standing wave ratio (VSWR) less than 2, the bandwidth of the first resonant frequency and that of the second resonant frequency cover 2.3–2.6 GHZ and 4.4–6.0 GHz, respectively. The two frequency bands are so wide that cover the bands (2.4 GHz and 5.2 GHz) for Wireless Local Area Network (WLAN).

FIGS. 3–8 respectively show horizontally and vertically polarized principle plane radiation patterns of the dual-band antenna 1 operating at frequencies of 2.45 GHz, 5.25 GHz and 5.8 GHz. Note that each radiation pattern is close to a corresponding optimal radiation pattern.

The slot 101 employed as impedance matching means can be other shapes besides rectangle. Referring to FIGS. 9–13, some other embodiments defining slots that have different shapes constructed by a cutting or etching technique is shown.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An antenna for a communication device comprising:

a first radiating element portion operating at a first frequency band;

a ground portion;

a conductive connection interconnecting said first radiating element portion with said ground portion; wherein the grounding portion defines a first slot having a closed end and an open end and located adjacent to said conductive connection, and a second slot spaced from said first slot; said second slot has two opposite closed ends.

2. The antenna as claimed in claim 1, wherein said first slot is adjacent to said first radiating element portion.

3. The antenna as claimed in claim 1, wherein said first and second slots are parallel to the direction of the length of said first radiating element portion.

4. The antenna claimed in claim 1, wherein said antenna comprises a second radiating element portion.

5. The antenna as claimed in claim 4, wherein said first radiating element portion and said second radiating element portion have different dimensions in length and width.

6. The antenna as claimed in claim 1, wherein said ground portion has a substantially L-shaped configuration.

7. The antenna as claimed in claim 1, further comprising a coaxial cable, which comprises a core conductor and an outer conductor.

8. The antenna as claimed in claim 7, wherein said core conductor of said coaxial cable is coupled to said conductive connection and said outer conductor of said coaxial cable is coupled to said ground portion.

9. The antenna as claimed in claim 1, wherein said first radiating element portion, said conductive connection and said ground portion are all arranged in a same plane.

10. The antenna as claimed in claim 1, wherein said antenna is an inverted-F antenna.

11. A method of matching the input impedance of an antenna with a feed line, comprising the following steps:

(a) providing an antenna, comprising a radiating element portion, a ground portion, a conductive connection and a feed point;

(b) fixing a feed line on said feed point of the antenna;

(c) the grounding portion defines a first slot having a closed end and an open end and located adjacent to said conductive connection, and a second slot spaced from said first slot; said second slot has two opposite closed ends; and (d) altering the dimensions of said second slot to match the input impedance of said antenna with said feed line.

12. The method as claimed in claim 11, wherein step (a) comprises locating said feed point of said antenna in said conductive connection of said antenna.

13. The method as claimed in claim 11, wherein said slot is parallel to the direction of the length of said radiating element portion of said antenna.

14. The method as claimed in claim 11, wherein said feed line is a coaxial cable.

15. An antenna for a communication device comprising:

a first radiating clement portion and a second radiating element portion respectively operating at a first frequency band and a second frequency band;

a ground portion; and a conductive connection extending at joint of said first radiating element portion and said second radiating element portion and connecting to said ground portion; wherein the ground portion defines a first slot having a closed end and an open end and located adjacent to said conductive connection, and a second slot having two opposite closed end and spaced from said first slot.

16. The antenna as claimed in claim 15, wherein said second slot is located by one side of the first slot in a direction along which the first radiating element portion extends from the joint, and wherein said first radiating element portion is longer than the second radiating element portion in said direction.

17. The antenna as claimed in claim 16, wherein said a third slot is formed between the ground portion and the first radiating element portion, and said third slot defines a closed end and an open end.

18. The antenna as claimed in claim 15, wherein a feeder cable is connected to the ground portion via an outer conductor and to the connection via an inner conductor, respectively.

* * * * *